US011326745B2

(12) United States Patent
Wang et al.

(10) Patent No.: US 11,326,745 B2
(45) Date of Patent: May 10, 2022

(54) LED LIGHT TUBE APPARATUS

(71) Applicant: XIAMEN LEEDARSON LIGHTING CO. LTD, Fujian (CN)

(72) Inventors: Linhua Wang, Fujian (CN); Shuijing Liang, Fujian (CN); Shou Chen, Fujian (CN)

(73) Assignee: XIAMEN LEEDARSON LIGHTING CO. LTD, Fujian (CN)

( * ) Notice: Subject to any disclaimer, the term of this patent is extended or adjusted under 35 U.S.C. 154(b) by 0 days.

(21) Appl. No.: 16/916,114

(22) Filed: Jun. 30, 2020

(65) Prior Publication Data

US 2021/0404609 A1 Dec. 30, 2021

(51) Int. Cl.

| | |
|---|---|
| ***F21K 9/278*** | (2016.01) |
| ***F21V 23/00*** | (2015.01) |
| ***F21K 9/272*** | (2016.01) |
| ***F21V 23/04*** | (2006.01) |
| ***F21K 9/69*** | (2016.01) |
| ***F21V 23/06*** | (2006.01) |
| ***F21V 29/70*** | (2015.01) |
| *F21Y 115/10* | (2016.01) |

(52) U.S. Cl.

CPC ..... *F21K 9/278* (2016.08); *F21K 9/272* (2016.08); *F21K 9/69* (2016.08); *F21V 23/005* (2013.01); *F21V 23/0435* (2013.01); *F21V 23/06* (2013.01); *F21V 29/70* (2015.01); *F21Y 2115/10* (2016.08)

(58) Field of Classification Search

CPC . F21K 9/278; F21K 9/272; F21K 9/69; F21V 23/005; F21V 23/0435; F21V 23/06; F21V 29/70; F21Y 2115/10

See application file for complete search history.

(56) References Cited

U.S. PATENT DOCUMENTS

| | | | | |
|---|---|---|---|---|
| 6,149,285 | A * | 11/2000 | Cicarelli | B44F 1/06 362/223 |
| 6,641,285 | B2 * | 11/2003 | Liu | H01J 61/30 362/223 |
| 10,197,224 | B1 * | 2/2019 | Macias | F21V 7/005 |
| 2013/0119896 | A1 * | 5/2013 | Fukano | H01R 33/0854 315/312 |
| 2013/0141890 | A1 * | 6/2013 | Carlin | F21K 9/278 362/20 |
| 2018/0317291 | A1 * | 11/2018 | Jiang | F21K 9/27 |
| 2019/0070326 | A1 * | 3/2019 | Xie | A46B 15/0085 |
| 2019/0157902 | A1 * | 5/2019 | Cannon | H05B 45/30 |
| 2020/0173613 | A1 * | 6/2020 | Zhang | H05B 45/3578 |

* cited by examiner

*Primary Examiner* — Britt D Hanley
*Assistant Examiner* — Glenn D Zimmerman
(74) *Attorney, Agent, or Firm* — Chun-Ming Shih; Lanway IPR Services

(57) ABSTRACT

A LED light tube apparatus installed to a tube bracket includes a LED light source and a light passing tube. A driver includes a driver circuit. A power input electrode that an external power is supplied to the driver for generating a driving current supplied to the LED light source. A first cap and a second being disposed at two opposite ends of the light passing tube. The first cap and the second cap respectively have two pins inserted into corresponding pin sockets for fixing the LED light tube apparatus to the tube bracket. The LED light tube provides an in-house power source to the pin sockets, but the in-house power is not routed to the driver from the pins.

19 Claims, 9 Drawing Sheets

LED LIGHT TUBE APPARATUS

FIELD

The present invention is related to a lighting apparatus and more particularly related to a LED light tube.

BACKGROUND

In modern society, the illuminating devices are widely used for illumination, and higher requirements are put on the illuminating device, for instance, the lamp is required to be capable of being turned on and off automatically and periodically, or capable of providing brightness to different degrees in different application scenes. In particular, it is required to wirelessly control the light to facilitate a remote and short-range operation. Accordingly, in various lighting devices, a wireless circuit and an antenna are especially arranged in a tube light for using a wireless communication protocol and an exterior light control center or a wireless controller to conduct communication so as to receive an instruction.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Light emitting diode (LED) lighting technology is rapidly developing to replace traditional incandescent and fluorescent lighting. LED tube lamps are mercury free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs and fluorescent tube lights. Benefits of LED lights include improved durability and longevity and far less energy consumption.

Although lighting devices are widely used, there are still lots of opportunity and benefit to improve the lighting devices to provide more convenient, low cost, reliable and beautiful lighting devices for enhancing human life.

SUMMARY

A LED light tube apparatus for installing to a tube bracket includes a LED light source and a light passing tube. The light passing tube apparatus encloses in the LED light source. A driver includes a driver circuit. The LED light tube apparatus includes a power input electrode. An external power is supplied to the driver. The external power generates a driving current supplied to the LED light source. The LED light tube includes a first cap and a second cap. The first cap and the second cap is disposed at two opposite ends of the light passing tube. The first cap and the second cap respectively having two pins. The two pins is for inserting into corresponding pin sockets of the tube bracket for fixing the LED light tube apparatus to the tube bracket. The LED light tube apparatus provides an in-house power source to the pin sockets, but the in-house power is not routed to the driver from the pins.

In some embodiments, the LED light tube apparatus has a heat of the LED light source is transmitted to the pins and go forward to the tube bracket. The heat is in the LED light tube apparatus that may decrease the life span of the LED light tube apparatus. The heat of the LED light source may be transmitted out by going through a path from the LED light tube apparatus through the pins to the tube bracket and be send out. In some embodiments, the first cap contains a heat sink for carrying away the heat from the LED light source. The heat sink may be a transmitter to send the heat from the LED light source in the LED light tube apparatus to the tube bracket.

In some embodiments, the first cap is detachable from the light passing tube to be replaced with a third cap. The third cap contains a second driver for converting a power source from a ballast on the tube bracket to the driving current for the LED light source. In some embodiments, the LED light tube apparatus also includes a forward electrode, the forward electrode routing a second power to another light apparatus. The LED light tube apparatus may be linked one to another light apparatus in parallel line. In some embodiments, the driver controls another light apparatus in addition to provide the second power to another light apparatus. In some embodiments, the LED light tube apparatus also includes a forward electrode for providing a second power to a second light apparatus of a different type from the LED light tube apparatus.

In some embodiments, the LED light tube apparatus also includes an extended electrode for attaching an attached device with power supplied by the driver. Several types of attached device may each have different functions. The attached device may be an emergency device, a backup battery, or a radio player, etc. Users may replace the attached device the user want or need by using the same light tube body and lighting base without changing the whole lighting structure.

In some embodiments, the attached device includes a wireless module for communicating with another light device. The wireless module may receive and provide a command to control the lighting pattern of the light tube. A first light tube may receive the command and pass it to a second light tube. The second light tube receives the command from the first light tube and light up itself and passes the command down to the other light tubes. The first light tube may give instructions to which the lights to turn on and which the lights to turn off by the time. The first light tube may provide electricity to another light tube while the electricity is cut off by any reasons. The first light tube may have a storage device for providing the illumination to the area when the electricity is off.

In some embodiments, the tube bracket is connected to a wall switch. The driver is controlled by both the wireless module and the wall switch. The wireless module may communicate with different devices such as a remote control, a cellphone, touch screen device or a switch on the wall. We may turn on the light in many ways based on the connections between the devices and the wireless module that receive a command from a user through the device to the light. When the connections between the devices and the light is cut off by accident, the light may also be turn on by a user through the connection of the wall switch and the tube bracket.

In some embodiments, the attached device provides information to another light device connected to the power input electrode. The attached device may be an emergency device, a backup battery, or a radio player, etc. The attached device provides different functional use for a user to select. The attached device may be a speaker which communicate with a user and receive and give a command based on the need of the user. The attached device may be a voice-activated assistant and a visual-activate assistant to mimic and sense human actions and conversations to operate the device or the function the user commanded.

In some embodiments, the attached device receives an operating parameter from a remote computer and instructs the driver to operate the light source according to the operating parameter. When a user is on a side of a screen, the light source is operated to be lighter on the side opposite to eyes of the user for providing the user a better visual angle and better lighting based on the direction of the user.

In some embodiments, the LED light tube apparatus also includes an indicator for showing a status of the light source. In some embodiments, the driver collects a status information and sends the status information to a remote device indicating a period estimated to replace the LED light tube apparatus. The indicator may include, for example, three different colors of instruction light, red, yellow and green. The green light is on showing a new changed light source which may provide the average lighting of a LED light tube apparatus. The yellow light is on showing a new light source may be prepared for changing the light which the light is decreasing an illumination of its average lighting. The red light is on showing the light needed to be changed in forty eight hours or the light may cut off at the end of its life span. The red light also shows if there is an error of the LED light tube apparatus to notice the user without checking the light.

In some embodiments, the input power electrode is a USB interface. The input power electrode is removable and may be used as a backup battery that has the USB interface to fit in most of the device structure to provide electricity without plugged into a power socket on the wall.

In some embodiments, the LED light tube apparatus also includes a diffusing cover fixed to the tube bracket to be mounted on a wall. The LED light tube apparatus may be on the ceiling to provide an illumination down to the ground, but the LED light tube apparatus may also be on the walls to provide a design lighting pattern.

In some embodiments, the LED light tube apparatus also includes a diffusion layer for covering the light passing tube. A sleeve layer is removable from the light passing tube. In some embodiments, the LED light tube apparatus also includes a sleeve tube covering the light passing tube. The sleeve tube is detachable from the light passing tube to be replaced with another sleeve tube providing different optical outputs. The sleeve layer may be connected to the light passing tube by a magnet unit or an interlock portion that makes the sleeve layer removable and attachable.

In some embodiments, the LED light tube apparatus also includes a sleeve tube covering the light passing tube. The sleeve tube has multiple lens with different parameters. The sleeve tube being rotatable with respect to the light passing tube. In some embodiments, the LED light tube apparatus also includes a sleeve tube with a first portion and a second portion covering the light passing tube. The first portion allows more light passing than the second portion. The first portion may have a lens structure for condensing a light to a light beam and the second portion has a diffusion layer for diffusing the light to a divergent light. The light beam may make a focus on an object the light irradiating. The divergent light provides a tender light to irradiate the object or also the surrounding place of the object.

It should be noted that, the following description of various embodiments of the present disclosure is described herein in order to clearly illustrate the inventive features of the present disclosure. However, it is not intended that various embodiments can only be implemented alone and rather it is contemplated that various of the different embodiments can be and are intended to be used together in a final product and can be combined in various ways to achieve various final products. Thus, people having ordinary skill in the art may combine the possible embodiments together or replace the components/modules between the different embodiments according to requirements. The embodiments herein are not limit to the form described in the following descriptions, any possible replacement and arrangement between the various embodiments are included.

DETAILED DESCRIPTION

Reference may now be made in detail to particular embodiments of the disclosure, examples of which are illustrated in the accompanying drawings. While the disclosure may be described in conjunction with the preferred embodiments, it may be understood that they may not intended to the limit the disclosure to these embodiments. On the contrary, the invention is intended to cover alternatives, modifications and equivalents that may be included within the spirit and scope of the disclosure as defined by the appended claims. Furthermore, in the following detailed description of the present disclosure, numerous specific details are set forth in order provide a thorough understanding of the present disclosure. However, it may be readily apparent to one skilled in the art that the present disclosure may be practiced without these specific details. In other instances, well-known methods, procedures, processes, components, structures, and circuits have not been described in detail so as not to unnecessarily obscure aspects of the present invention.

Figure 1:
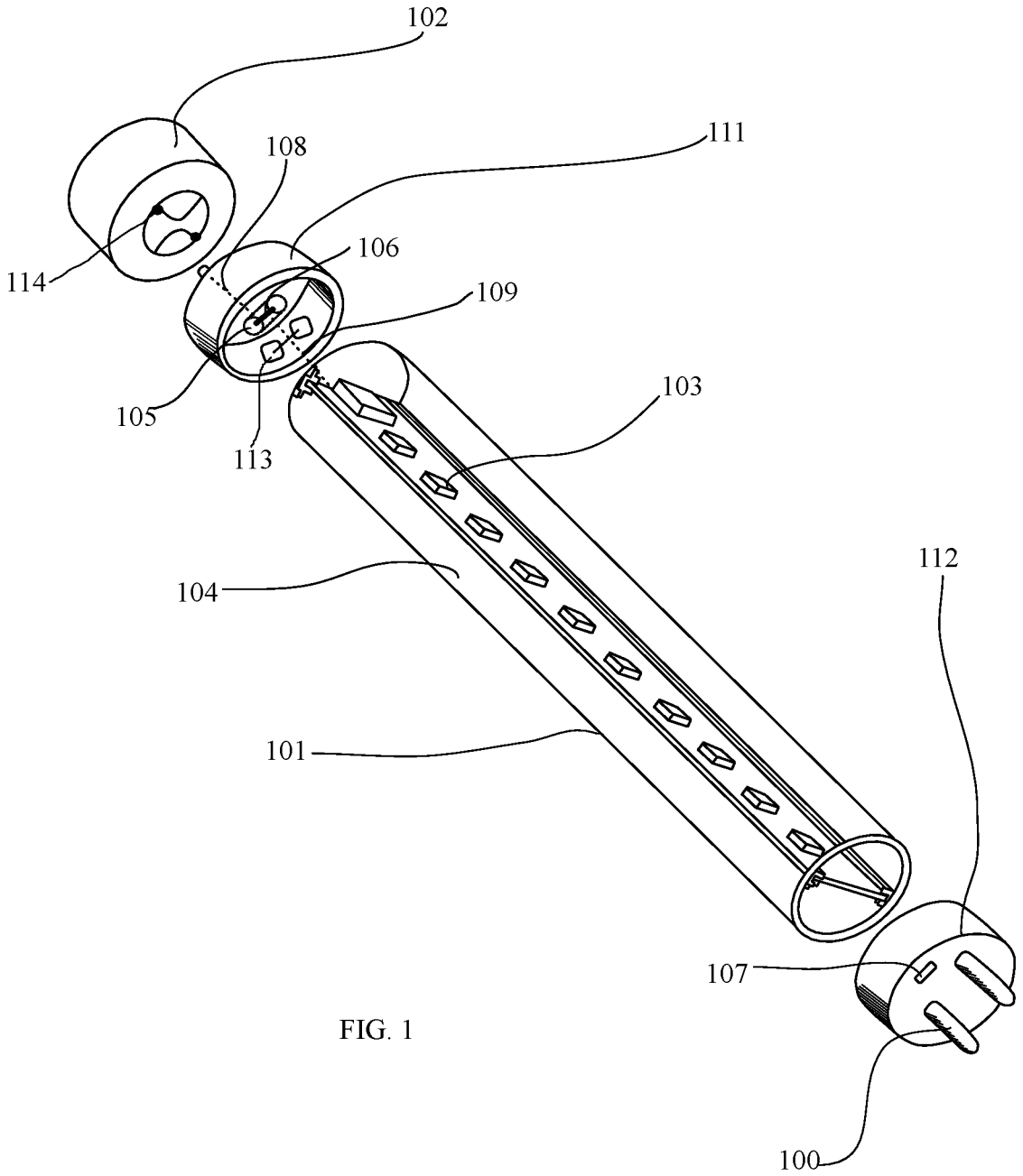
FIG. 1 is a perspective view of a LED light tube apparatus according to an embodiment of the present disclosure.

Please refer to FIG. 1. FIG. 1 is a perspective view of a LED light tube apparatus according to an embodiment of the present disclosure. The LED light tube apparatus 101 for installing to a tube bracket 102 includes a LED light source 103 and a light passing tube 104. The light passing tube 104 encloses in the LED light source 103. A driver 105 includes a driver circuit 106. The LED light tube apparatus 101 includes a power input electrode 107. An external power 108 is supplied to the driver 105. The external power 108 generates a driving current 109 supplied to the LED light source 103. The LED light tube apparatus 101 includes a first cap 111 and a second cap 112. The first cap 111 and the second cap 112 is disposed at two opposite ends of the light passing tube 104. The first cap 111 and the second cap 112 respectively having two pins 100. The two pins 100 is for inserting into corresponding pin sockets 114 of the tube bracket 102 for fixing the LED light tube apparatus 101 to the tube bracket 102. The LED light tube apparatus 101 provides an in-house power source 113 to the pin sockets 114, but the in-house power source 113 is not routed to the driver 105 from the pins.

Figure 2:
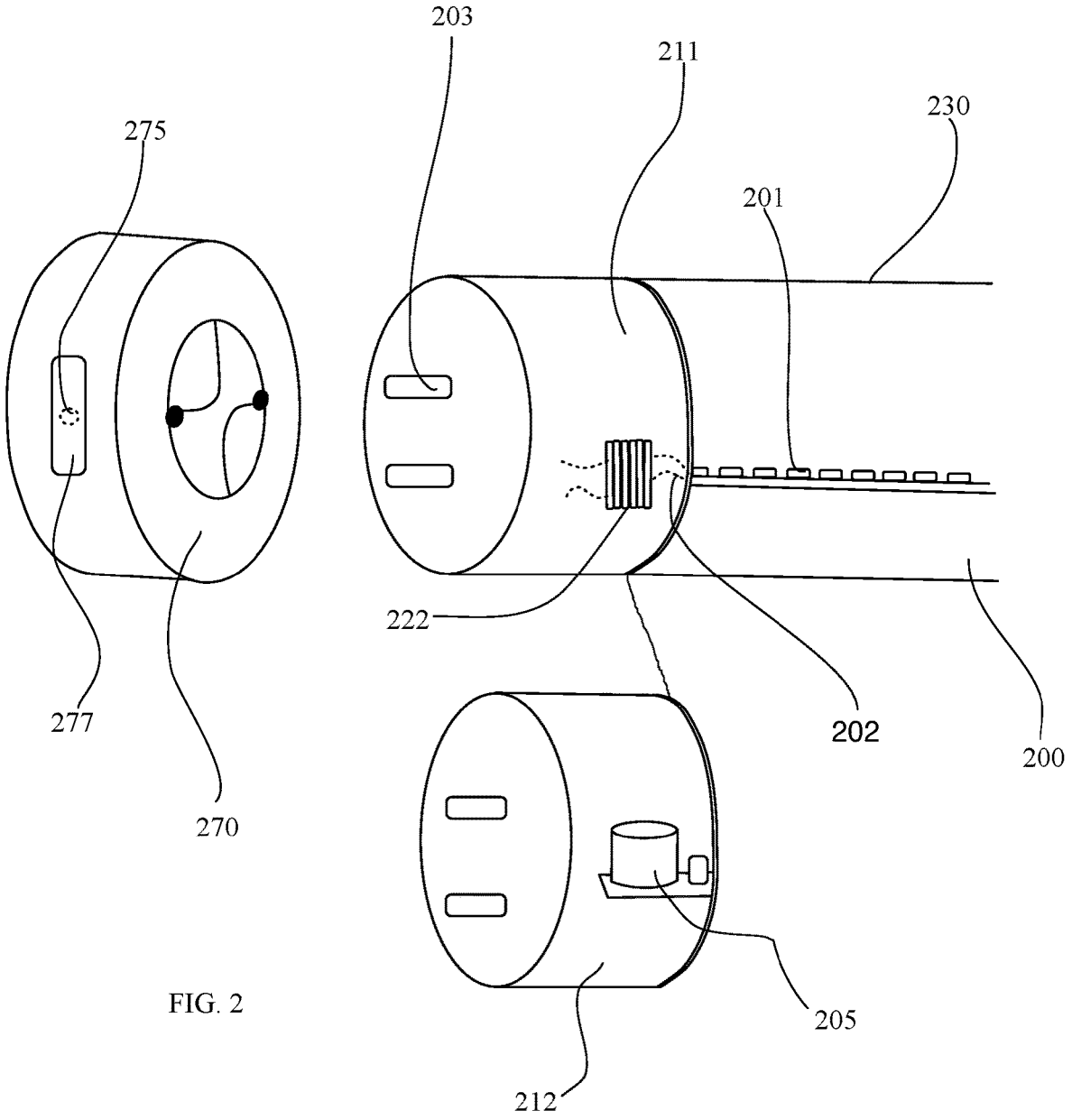
FIG. 2 is a side schematic view of a LED light tube apparatus according to an embodiment of the present disclosure.

Please refer to FIG. 2. FIG. 2 is a side schematic view of a LED light tube apparatus according to an embodiment of the present disclosure. The LED light tube apparatus 200 has a heat 202 of the LED light source 201 is transmitted to the pins 203 and go forward to the tube bracket 270. The heat 202 is in the LED light tube apparatus 200 that may decrease the life span of the LED light tube apparatus 200. The heat 202 of the LED light source 201 may be transmitted out by going through a path from the LED light tube apparatus 200 through the pins 203 to the tube bracket 270 and be send out. In some embodiments, the first cap contains a heat sink 222 for carrying away the heat 202 from the LED light source 201. The heat sink 222 may be a transmitter to send the heat 202 from the LED light source 201 in the LED light tube apparatus 200 to the tube bracket 270. In some embodiments, the first cap 211 is detachable from the light passing tube 230 to be replaced with a third cap 212. The third cap 212 contains a second driver 205 for converting a power source 275 from a ballast 277 on the tube bracket 270 to the driving current for the LED light source 201.

Figure 3:
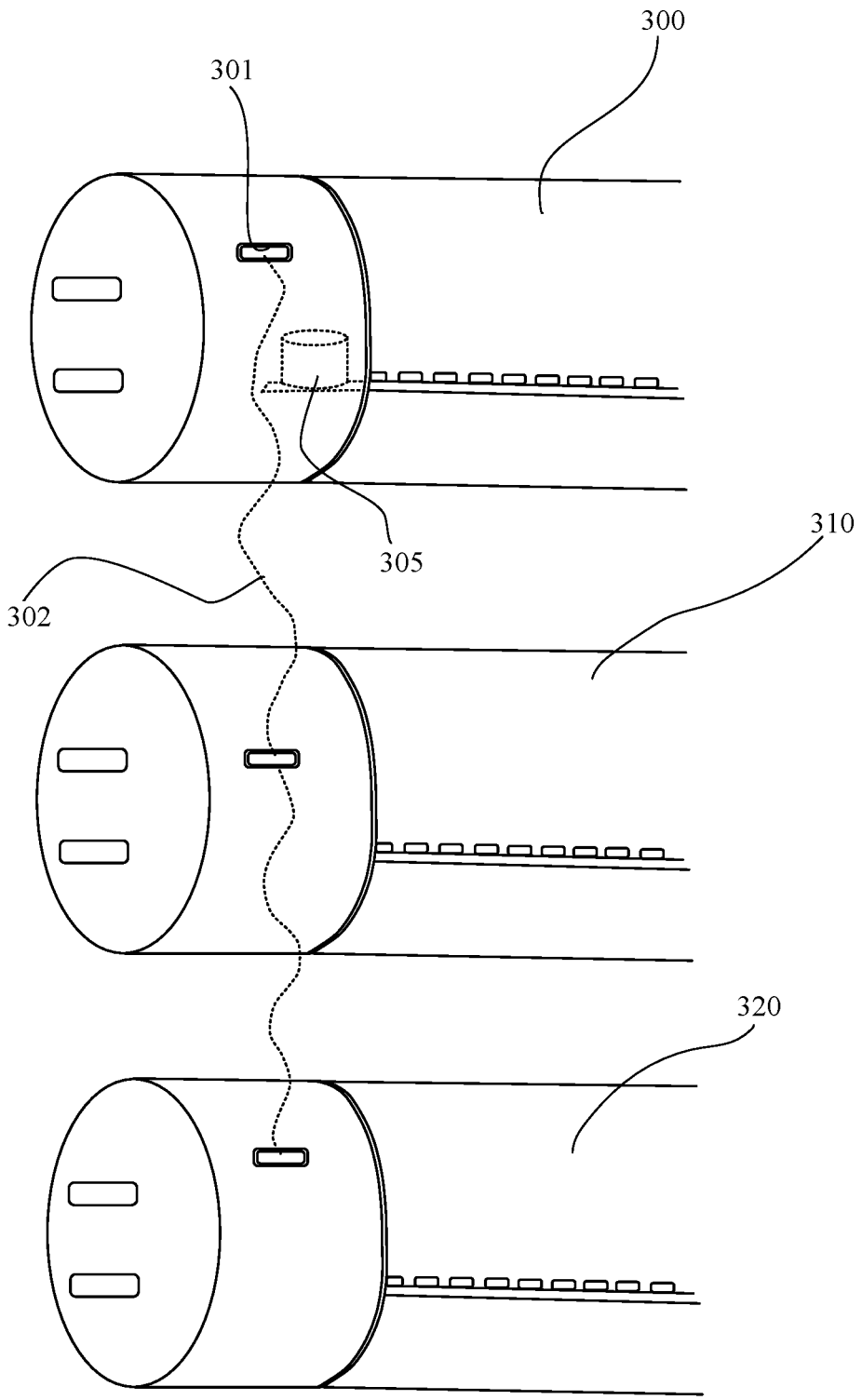
FIG. 3 is a side perspective view of a LED light tube apparatus according to an embodiment of the present disclosure.

Please refer to FIG. 3. FIG. 3 is a side perspective view of a LED light tube apparatus according to an embodiment of the present disclosure. The LED light tube apparatus 300 also includes a forward electrode 301, the forward electrode 301 routing a second power 302 to another light apparatus 310. The LED light tube apparatus 300 may be linked one to another lighting apparatus 310 in parallel line. In some embodiments, the driver 305 controls another light apparatus 310 in addition to provide the second power 302 to another light apparatus 310. In some embodiments, the LED light tube apparatus 300 also includes a forward electrode 301 for providing a second power 302 to a second light apparatus 320 of a different type from the LED light tube apparatus 300.

Figure 4A:
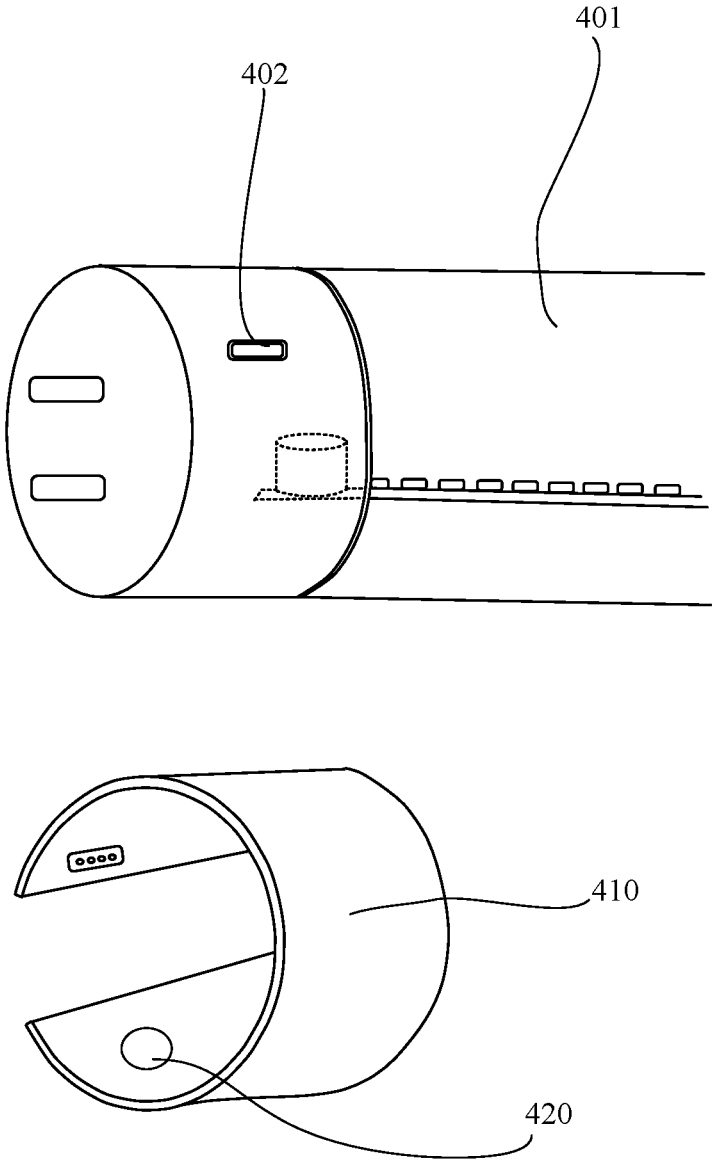
FIG. 4A is a schematic view of a LED light tube apparatus according to an embodiment of the present disclosure.
Figure 4B:
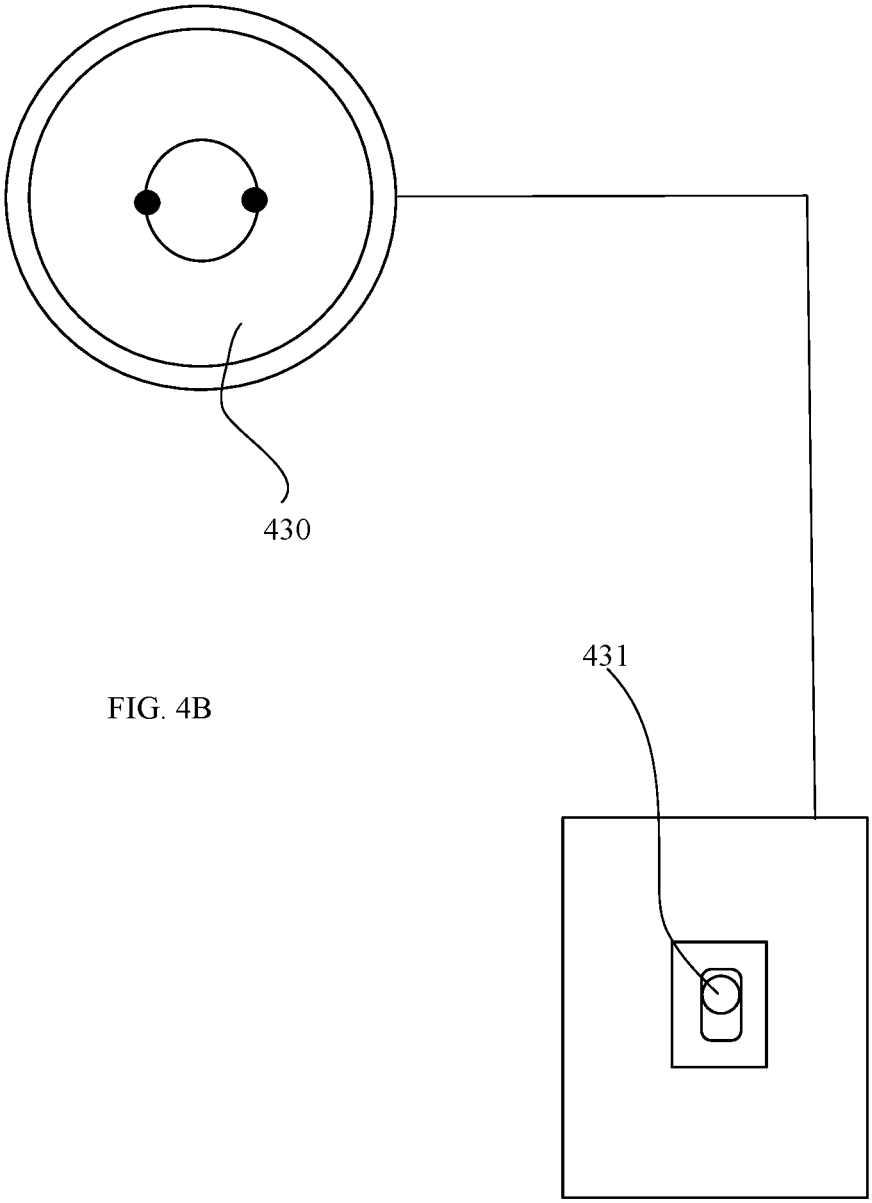
FIG. 4B illustrates a tube bracket and a wall switch according to an embodiment of the present disclosure.

Please refer to FIG. 4A and FIG. 4B. FIG. 4A is a schematic view of a LED light tube apparatus according to an embodiment of the present disclosure. FIG. 4B illustrates a tube bracket and a wall switch according to an embodiment of the present disclosure. The LED light tube apparatus 401 also includes an extended electrode 402 for attaching an attached device 410 with power supplied by the driver. Several types of the attached device 410 may each have different functions. The attached device 410 may be an emergency device, a backup battery, or a radio player, etc. Users may replace the attached device 410 they want or need by using the same light tube body and lighting base without changing the whole lighting structure.

In some embodiments, the attached device includes a wireless module 420 for communicating with another light device. The wireless module 420 may receive and provide a command to control the lighting pattern of the light tube apparatus 401. A first light tube may receive the command and pass it to a second light tube. The second light tube receives the command from the first light tube and light up itself and passes the command down to the other light tubes. The first light tube may give instructions to which the lights to turn on and which the lights to turn off by the time. The first light tube may provide electricity to another light tube while the electricity is cut off by any reasons. The first light tube may have a storage device for providing the illumination to the area when the electricity is off.

In some embodiments, the tube bracket 430 is connected to a wall switch 431. The driver is controlled by both the wireless module 420 and the wall switch 431. The wireless module 420 may communicate with different devices such as a remote control, a cellphone, touch screen device or a switch on the wall. We may turn on the light in many ways based on the connections between the devices and the wireless module 420 that receives a command from a user through the device to the light. When the connections between the devices and the light is cut off by accident, the light may also be turn on by a user through the connection of the wall switch 431 and the tube bracket 430.

In some embodiments, the attached device 410 provides information to another light device connected to the power input electrode. The attached device 410 may be an emergency device, a backup battery, or a radio player, etc. The attached device 410 provides different functional use for a user to select. The attached device 410 may be a speaker which communicate with a user and receive and give a command based on the need of the user. The attached device 410 may be a voice-activated assistant and a visual-activate assistant to mimic and sense human actions and conversations to operate the device or the function the user commanded.

Figure 5:
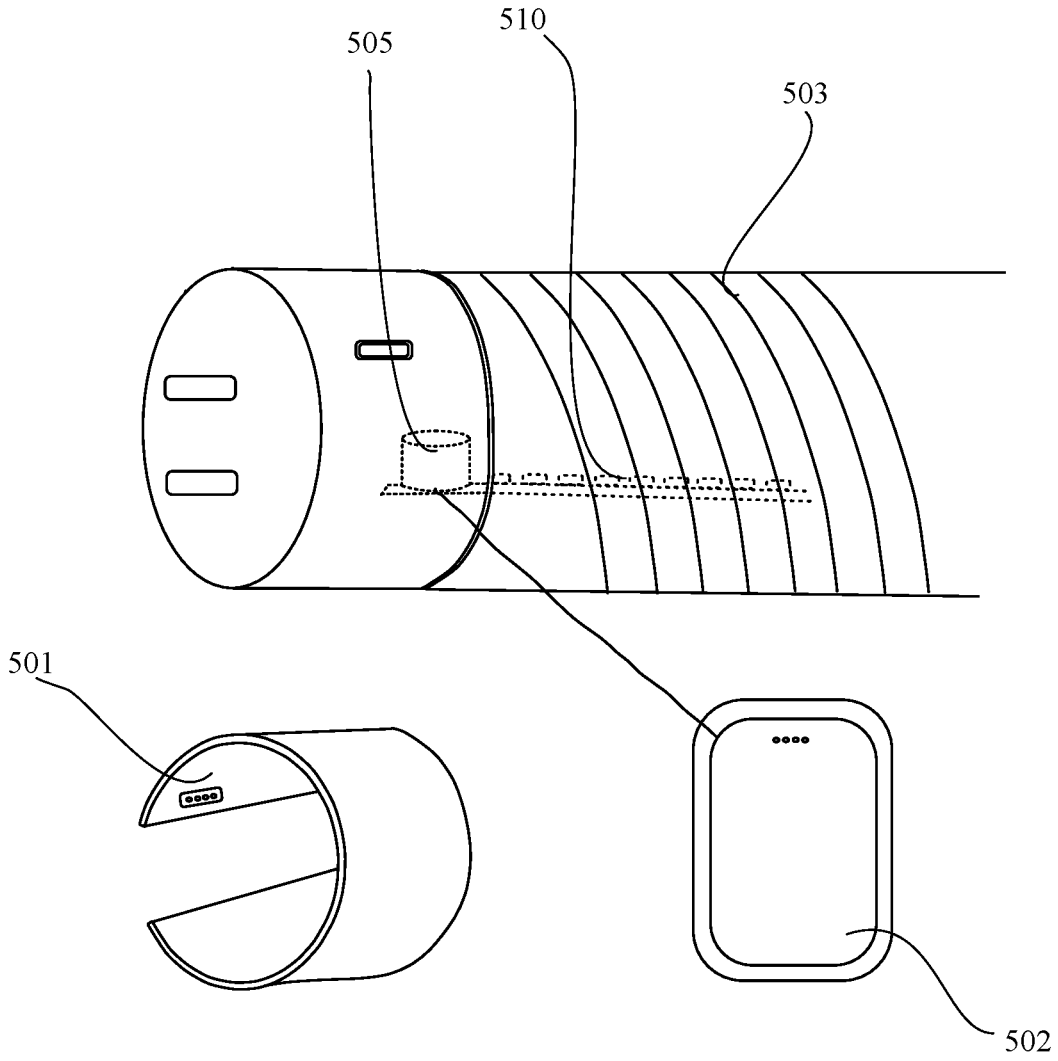
FIG. 5 illustrates a LED light tube apparatus according to an embodiment of the present disclosure.

Please refer to FIG. 5. FIG. 5 illustrates a LED light tube apparatus according to an embodiment of the present disclosure. The attached device 501 receives an operating parameter 503 from a remote computer 502 and instructs the driver 505 to operate the light source 510 according to the operating parameter 503. When a user is in an angle of a side of a screen, the light source 510 is operated to be lighter on the side opposite to eyes of the user for providing the user a better visual angle and better lighting based on the direction of the user.

Figure 6:
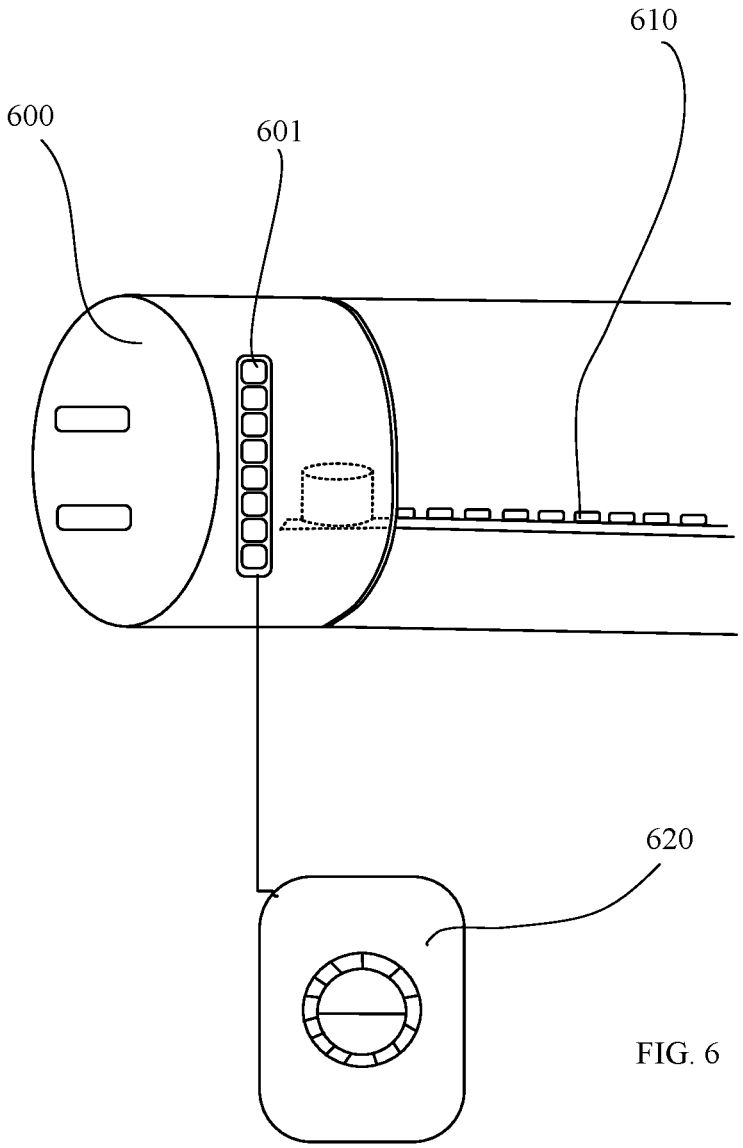
FIG. 6 illustrates a LED light tube apparatus according to an embodiment of the present disclosure.

Please refer to FIG. 6. FIG. 6 illustrates a LED light tube apparatus according to an embodiment of the present disclosure. The LED light tube apparatus 600 also includes an indicator 601 for showing a status of the light source 610. In some embodiments, the driver collects a status information and sends the status information to a remote device 620 indicating a period estimated to replace the LED light tube apparatus 600. The indicator 601 may include, for example, three different colors of instruction light, red, yellow and green. The green light is on showing a new changed light source which may provide the average lighting of a LED light tube apparatus 600. The yellow light is on showing a new light source may be prepared for changing the light which the light is decreasing an illumination of its average lighting. The red light is on showing the light needed to be changed in forty eight hours or the light may cut off in the end of its life span. The red light also shows if there is an error of the LED light tube apparatus 600 to notice the user without checking the light.

Figure 7:
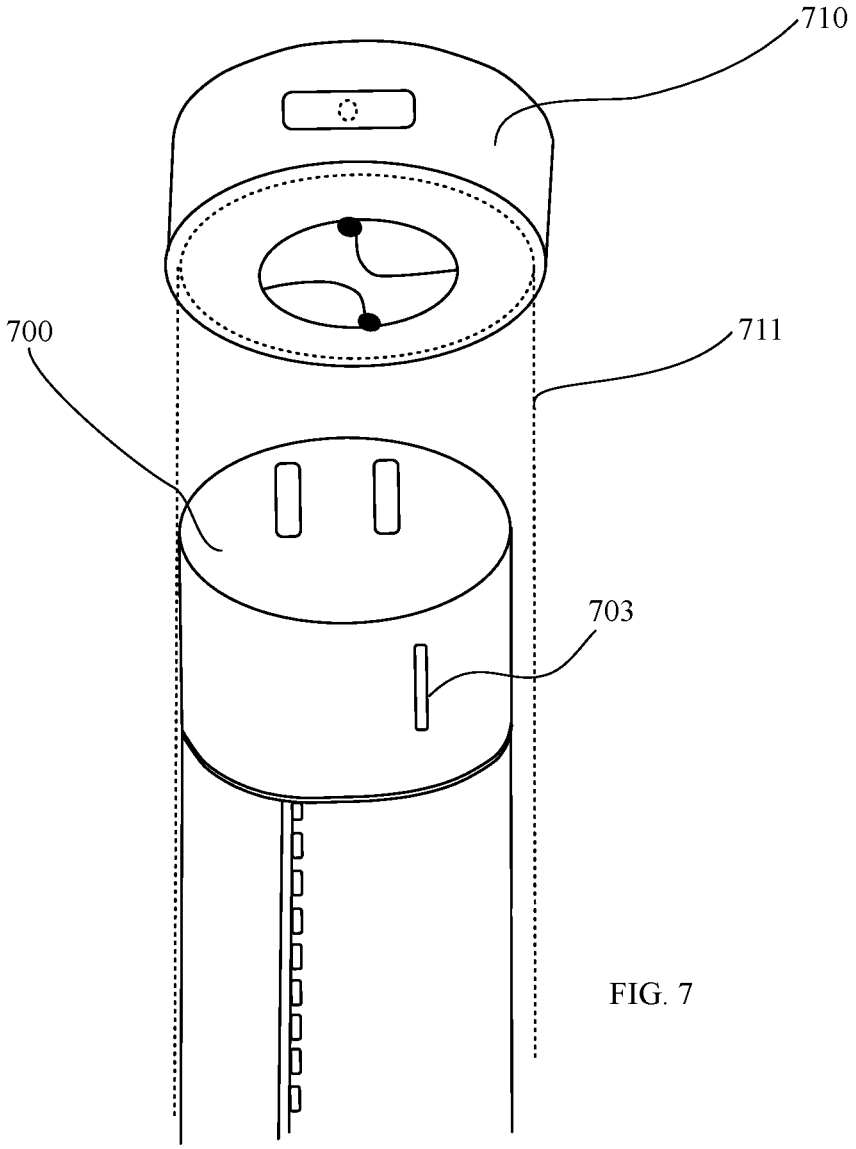
FIG. 7 is a schematic view of a LED light tube apparatus according to an embodiment of the present disclosure.

Please refer to FIG. 7. FIG. 7 is a schematic view of a LED light tube apparatus according to an embodiment of the present disclosure. The input power electrode 703 is a USB interface. The input power electrode 703 is removable and may be used as a backup battery that has the USB interface to fit in most of the device structure to provide electricity without plugged into a power socket on the wall.

In some embodiments, the LED light tube apparatus 700 also includes a diffusing cover 711 fixed to the tube bracket 710 to be mounted on a wall. The LED light tube apparatus 700 may be on the ceiling to provide an illumination down to the ground, but the LED light tube apparatus 700 may also be on the walls to provide a design lighting pattern.

Figure 8:
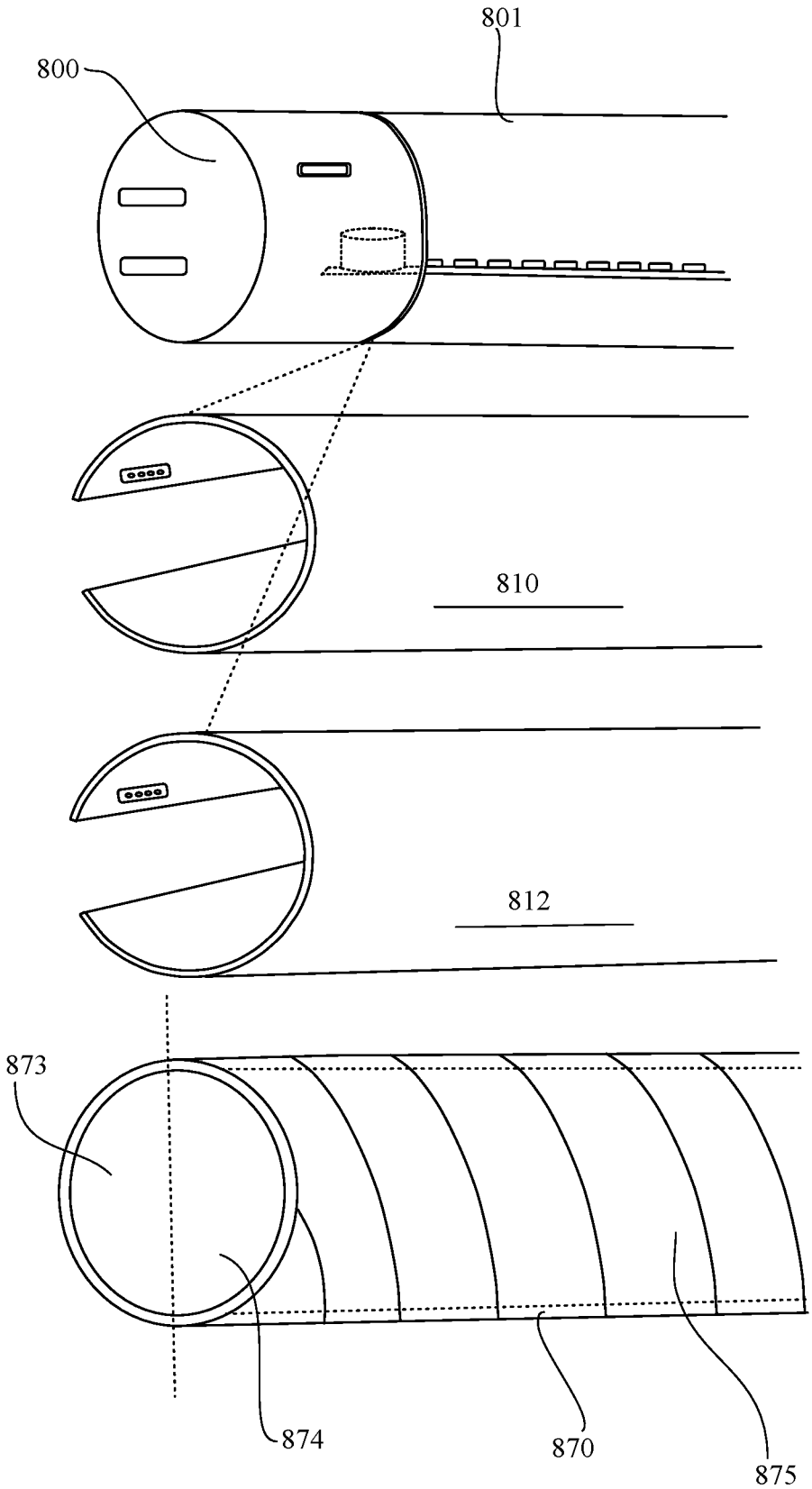
FIG. 8 is a side perspective view of a LED light tube apparatus according to an embodiment of the present disclosure.

Please refer to FIG. 8. FIG. 8 is a side perspective view of a LED light tube apparatus according to an embodiment of the present disclosure. The LED light tube apparatus 800 also includes a diffusion layer 810 for covering the light passing tube 801.

A sleeve layer 812 is removable from the light passing tube 801.

In some embodiments, the LED light tube apparatus 800 includes a sleeve tube 870 covering the light passing tube 801. The sleeve tube 870 is detachable from the light passing tube 801 to be replaced with another sleeve tube providing different optical outputs.

In some embodiments, the LED light tube apparatus 800 also includes a sleeve tube 870 covering the light passing tube 801. The sleeve tube 870 has multiple lens 875 with different parameters. The sleeve tube 870 being rotatable with respect to the light passing tube 801. In some embodiments, the LED light tube apparatus 800 also includes a sleeve tube 870 with a first portion 873 and a second portion 874 covering the light passing tube 801. The first portion 873 allows more light passing than the second portion 874.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A LED light tube apparatus for installing to a tube bracket, comprising:

a LED light source;

a light passing tube enclosing the LED light source;

a driver comprising a driver circuit;

a power input electrode, an external power being supplied to the driver for generating a driving current supplied to the LED light source;

a first cap;

a second cap, the first cap and the second cap being disposed at two opposite ends of the light passing tube, the first cap and the second cap respectively having two pins for inserting into corresponding pin sockets of the tube bracket for fixing the LED light tube apparatus to the tube bracket, the LED light tube providing an in-house power source to the pin sockets, but the in-house power source being not routed to the driver from the pins; and an extended electrode for attaching an attached device with power supplied by the driver.

2. The LED light tube apparatus of claim 1, wherein a heat of the LED light source is transmitted to the pins forwarding to the tube bracket.

3. The LED light tube apparatus of claim 1, wherein the first cap contains a heat sink for carrying away the heat from the LED light source.

4. The LED light tube apparatus of claim 1, wherein the first cap is detachable from the light passing tube to be replaced with a third cap containing a second driver for converting a power source from a ballast on the tube bracket to the driving current for the LED light source.

5. The LED light tube apparatus of claim 1, further comprising a forward electrode, the forward electrode routing a second power to another light apparatus.

6. The LED light tube apparatus of claim 1, further comprising a forward electrode for providing a second power to a second light apparatus of a different type from the LED light tube apparatus.

7. The LED light tube apparatus of claim 1, wherein the attached device comprises a wireless module for communicating with another light device.

8. The LED light tube apparatus of claim 1, wherein the attached device provides information to another light device connected to the power input electrode.

9. The LED light tube apparatus of claim 1, wherein the attached device receives an operating parameter from a remote computer and instructs the driver to operate the light source according to the operating parameter.

10. The LED light tube apparatus of claim 1, further comprising an indicator for showing a status of the light source.

11. The LED light tube apparatus of claim 1, wherein the driver collects a status information and sends the status information to a remote device indicating a period estimated to replace the LED light tube apparatus.

12. The LED light tube apparatus of claim 1, wherein the input power electrode is a USB interface.

13. The LED light tube apparatus of claim 1, further comprising a diffusing cover fixed to the tube bracket to be mounted on a wall.

14. The LED light tube apparatus of claim 1, further comprising a diffusion layer for covering the light passing tube, a sleeve layer being removable from the light passing tube.

15. The LED light tube apparatus of claim 1, further comprising a sleeve tube covering the light passing tube, the sleeve tube is detachable from the light passing tube to be replaced with another sleeve tube providing different optical outputs.

16. The LED light tube apparatus of claim 1, further comprising a sleeve tube covering the light passing tube, the sleeve tube having multiple lens with different parameters, the sleeve tube being rotatable with respect to the light passing tube.

17. The LED light tube apparatus of claim 1, further comprising a sleeve tube with a first portion and a second portion covering the light passing tube, the first portion allows more light passing than the second portion.

18. The LED light tube apparatus of claim 5, wherein the driver controls the another light apparatus in addition to provide the second power to the another light apparatus.

19. The LED light tube apparatus of claim 7, wherein the tube bracket is connected to a wall switch, the driver is controlled by both the wireless module and the wall switch.

* * * * *